United States Patent [19]

Malek

[11] 4,057,484

[45] Nov. 8, 1977

[54] PROCESS FOR HYDROLIQUEFYING COAL OR LIKE CARBONACEOUS SOLID MATERIALS

[76] Inventor: John Michael Malek, P.O. Box 2870, Pasadena, Calif. 91105

[21] Appl. No.: 640,946

[22] Filed: Dec. 15, 1975

[51] Int. Cl.[2] ..... C10G 1/00

[52] U.S. Cl. ..... 208/8; 48/197 R

[58] Field of Search ..... 48/197 R; 208/8, 10

[56] References Cited

U.S. PATENT DOCUMENTS

| | | | |
|---|---|---|---|
| 2,191,156 | 2/1940 | Pier et al. | 208/10 |
| 2,885,337 | 5/1959 | Keith et al. | 208/8 |
| 3,642,607 | 2/1972 | Seitzer | 208/8 |
| 3,700,583 | 10/1972 | Solamony et al. | 208/8 |
| 3,846,275 | 11/1974 | Urban | 208/10 |
| 3,867,275 | 2/1975 | Gleim et al. | 208/8 |
| 3,892,654 | 7/1975 | Wright et al. | 208/8 |

*Primary Examiner*—Joseph Scovronek

[57] ABSTRACT

In this process the products of the dissolution-hydrogenation of coal or the like material in a hydrocarbon rich solvent are subjected in their slurryform fraction to an asphaltenes decomposing action of an alkali, like caustic soda or, being admixed after the gasiform fraction of the hydrogenation products has been taken off the slurryform fraction of the hydrogenation products now including the admixed alkali is subjected to a rehydrogenation by a hydrogen rich gas which after its rehydrogenating use is preferably applied, as source of hydrogen, to said dissolution-hydrogenation of coal. Optionally the admixed alkali includes minor amounts of a carboxylic acid salt of calcium.

13 Claims, 1 Drawing Figure

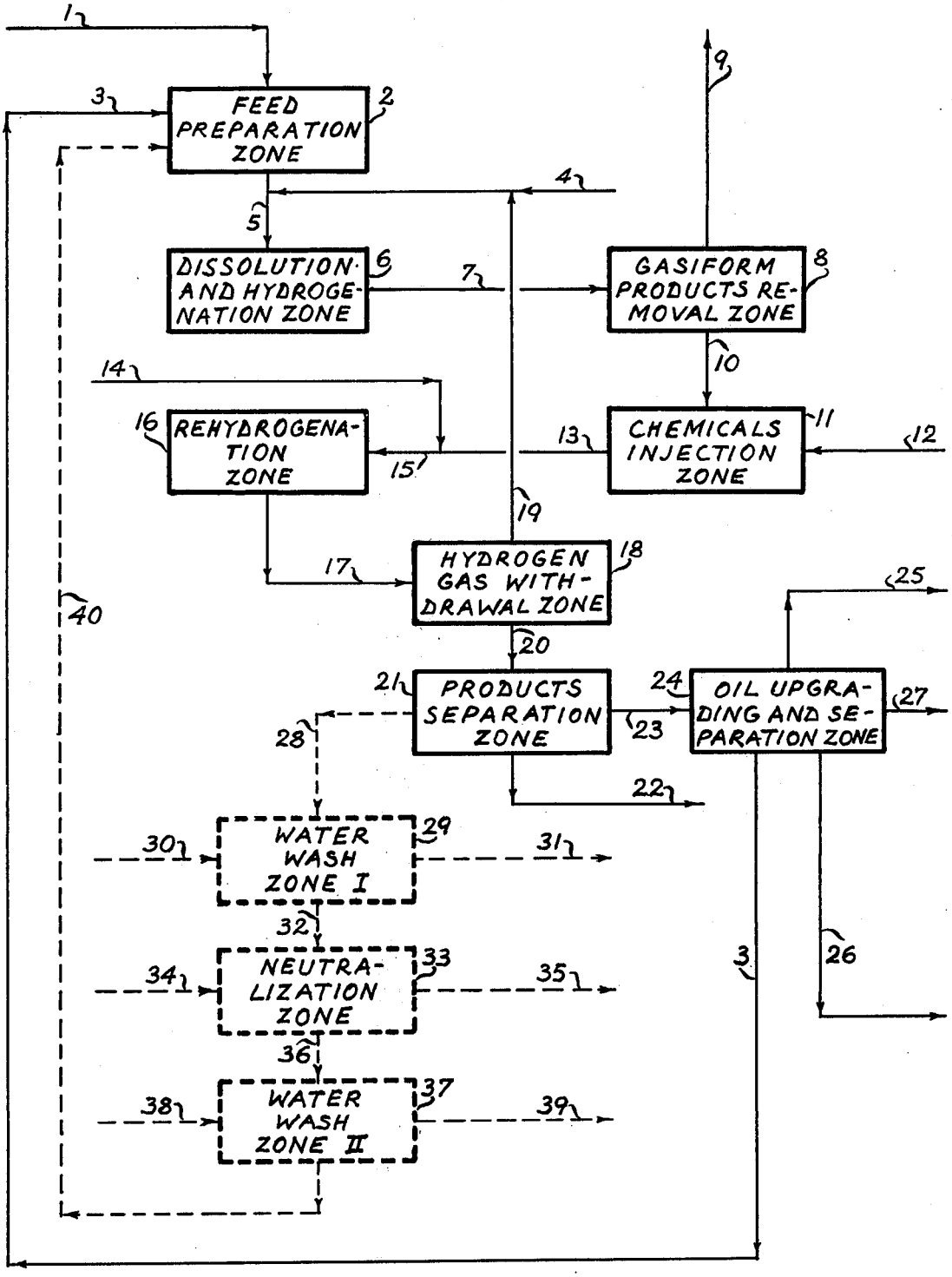
FEED PREPARATION ZONE
DISSOLUTION AND HYDROGENATION ZONE
GASIFORM PRODUCTS REMOVAL ZONE
REHYDROGENATION ZONE
CHEMICALS INJECTION ZONE
HYDROGEN GAS WITHDRAWAL ZONE
PRODUCTS SEPARATION ZONE
OIL UPGRADING AND SEPARATION ZONE
WATER WASH ZONE I
NEUTRALIZATION ZONE
WATER WASH ZONE II

PROCESS FOR HYDROLIQUEFYING COAL OR LIKE CARBONACEOUS SOLID MATERIALS

This invention relates to processes for hydrogenating and liquefying high molecular weight carbonaceous materials like coal, in a hydrocarbon rich solvent, in order to produce liquid and gaseous fuels.

Known processing systems for producing liquid and gaseous hydrocarbons from carbonaceous materials like subbituminous or bituminous coals generally include, in a succesive order, a coal pasting zone wherein the carbonaceous material is subjected to a thorough mixing with a hydrocarbon rich liquid solvent and the resulting pasteform mixture is preheated, a hydrogenation-dissolution zone wherein the dissolving carbonaceous material is subjected to chemical reactions with hydrogen in a hydrogenating reactor, under higher pressures and temperatures, to yield hydrocarbon products, organic solids, coal minerals and reaction by-products like carbon dioxide and hydrogen sulfide, and a primary separation zone for separating gasiform products including most of carbon dioxide and hydrogen sulfide from slurry- and/or liquidform products of the hydrogenation reactions.

In such known processes for hydrogenating carbonaceous materials of a high molecular weight, the slurryform products in and from the hydrogenation zone still contain partly undissolved, or dissolved but unreacted, carbonaceous constituents of a relatively high molecular weight, exerting a very undesired high viscosity impact on the slurryform medium. In fact a higher viscosity of the medium hinders the hydrogen diffusion and reaction rates in the hydrogenating reactor.

Such carbonaceous constituents of a high molecular weight comprise a large amount of asphaltenes, characterized by acid-base type structures.

The present invention is particularly directed toward an improved chemical processing of the slurryform products originating from a chemical reactor for hydrogenating coal and like materials.

One object of the invention is to provide a process whereby the undissolved and dissolved asphaltenes, still remaining in the slurryform products originating from a reactor for hydrogenating high molecular weight carbonaceous materials, may be decomposed and effectively hydrogenated to furnish higher overall yields of desired hydrogenated products.

Another object of the invention is to provide for lower viscosities of the slurryform and raw liquid products originating from the hydrogenating reactor.

A secondary object of this invention is to provide a means for an economical removal of the dissolved sour gases, comprising essentially carbon dioxide and hydrogen sulfide, from the slurryform hydrogenated products.

In order to attain these objectives a chemical treatment of the asphaltenes will be used prior to a rehydrogenation, whereby the base-acid structures of the asphaltenes may be broken by the applied reactive chemicals. The chemicals to be applied to this purpose are preferably low cost materials acting as bases stronger than the basic groups of the asphaltene structures. Such materials include hydroxides of alkali metals, hydroxides and oxides of alkaline-earth metals, and a possible presence of carboxylic acids or their calcium salts. Also ammonium hydroxide and alkali metal carbonates like $Na_2CO_3$, $NaHCO_3$, $K_2CO_3$ may be applied but with a weaker effect.

One might consider to apply an inorganic base, like sodium hydroxide, to the contents of a hydrogenating reactor. Such an application of a strong base however would imply reacting this base with carbon dioxide and hydrogen sulfide usually present in substantial amounts in the fluidform contents of a coal or like organic material hydrogenating reactor, and consequently it would imply a formation of carbonates, sulfides, etc, precipitating in the reacting medium; and if these precipitates are in large amounts they would foul surfaces of other solid particles in the reactor, including those which act as catalysts, and thus - catalytic reaction rates would decrease.

Therefore, if the operation has to be economical, such a mineral base must be applied to a medium wherein the amount of sour gases mainly comprising carbon dioxide and hydrogen sulfide is as low as possible. In order to satisfy this condition, a removal of a largest fraction of the sour gases from the products leaving a hydrogenating reactor is necessary prior to the basic chemical treatment.

In the case of applying a low cost mineral acid, like sulfuric acid, or generally more costly hydrochloric acid, instead of the base, as a means for breaking the acid-base structures of asphaltenes, there would be a risk of a harmful action of the mineral acid on the catalytically acting solid materials present in the medium being subjected or to be subjected to a hydrogenation if these catalytic materials are base metal oxides. In fact, if the base metal oxide surface structures are damaged by the acid, the reaction rates and yields of desired products would decrease. Another risk of applying such an acid, especially the hydrochloric acid, is generally corrosive action of it on the usual process equipment construction materials, and in the case of sulfuric acid, which is an oxidant, its introduction into a reducing environment of a hydrogenating operation would give rise to some undesired chemical reactions with reducing substances, resulting in a possible partial conversion of the oxidizing acid into unwanted gaseous or liquid byproducts like various sulfur compounds.

Of course, if the action of the applied base (or acid) has to be more efficient, the medium into which these chemicals are injected or introduced has to be of a higher fluidity. Therefore the operation shall be preferably performed at higher temperatures implying lower viscosities of the medium.

In conclusion, following one idea of the invention, preferably a mineral base, like caustic soda, will be used, at a higher temperature, for decomposing acid-base type compounds in hydrogenation products from which gases including carbon dioxide and other sour gases have been in principal removed.

Following a main feature of the invention, the improved process for producing liquid and gaseous fuels from high molecular weight carbonaceous materials like subbituminous or bituminous coal comprises, in addition to the known processing which includes preparing carbonaceous feed, providing a source of hydrogen, hydrogenating-dissolving the coal, and separating gasiform products from the slurryform or liquidform ones, the following processing: decomposing asphaltenes by means of a chemical, preferably a strong alkali, being injected to said slurryform for breaking the acid-base type structures of asphaltenes, admixing hydrogen to the slurryform, and rehydrogenating the latter, and separating the resulting rehydrogenation products.

In the asphaltenes decomposing step which may be called also chemicals injection step, a stream of a chemical acting as a relatively strong base or acid is introduced into the slurry which has been hydrogenated and separated from gases which comprise carbon dioxide and hydrogen sulfide, but preferably it is a diluted strong base, like an alkali metal hydroxide in water solution, and both streams are thoroughly mixed to provide a better contact between reactants.

If, for example, the applied chemical is a caustic soda, the latter will be subjected to react with the dissolved in relatively small amounts carbon dioxide and hydrogen sulfide in the slurryform products, and with at least a part of asphaltenes in which the acid-base organic structures may be subsequently broken, basic groups of these structures getting substituted by sodium, and being released in form of free organic bases like arylamines, while the substitutes represent sodium salts of the organic acid groups from said structures.

Following a secondary feature of the invention, the source of hydrogen for the hydrogenation operation consists in a hydrogen rich gas which after being subjected to react with the slurry constituents in the rehydrogenation zone is transferred to the hydrogenation-dissolution operation to be used therein for reacting with the carbonaceous materials in the hydrogenating reactor.

The accompanying drawing showing a block flow diagram representing an example of a preferred form of the new and improved process will serve a better understanding of the invention.

Following this block flow diagram, a pulverized higher grade coal is conducted through the line 1 into the feed preparation zone 2. In this zone the coal is admixed with a pasting oil from line 3. This pasting oil is a recycle oil produced in the process as will be described. In general from one to two weight parts of pasting oil per weight part of coal provides a suitable fluid consistency for reaction.

The mixture of coal and pasting oil is pumped along with hydrogen from line 4 through line 5 and through a preheater (not shown) into the dissolution-hydrogenation zone 6. Typical operating pressure and temperature for the reactions in this zone are in a broader range 1000–3000 PSIA and 700°–900° F respectively, and in the preferred range they are 1000–2500 PSIA and 750°–850° F respectively.

The hydrogenated products are withdrawn from the dissolution-hydrogenation zone 6 and passed through line 7 to the gasiform products removal zone 8. Hydrogen rich gas, including most of usually by-produced carbon dioxide and hydrogen sulfide is taken off through line 9 for a further treating (not shown). The remaining product in form of a slurry is transferred from the gasiform products removal zone 8 through line 10 into a chemicals injection zone 11 wherein the said slurry product is admixed with a water diluted alkali base which in this case is sodium hydroxide (caustic soda), preferably with admixed minor amounts of a carboxylic acid salt of calcium, like calcium acetate, injected through the line 12. Typical operating conditions for this injection zone are as follows:

| | Broad range | Preferred range |
|---|---|---|
| Pressure, PSIA | 900–3000 | 100 less than in dissolution-hydrogenation zone |
| Temperature, ° F | 200–900 | 300–600[1)] |
| Injection rate, wt. %[2)] of NaOH | 0.1–3.0 | up to 1.0 |
| wt. % of NaOH, in water solution | up to 50 | up to 20 |

[1)]The temperature of the solution being injected preferably has to be lower than solution temperature at equilibrium with the temperature of steam saturation at the operating pressure.

[2)]Weight percent based on MAF coal (meaning: moisture and ash free coal feed).

The slurry mixture from this zone 11 is then pumped or passed through line 13 and along with hydrogen from line 14 through line 15 (and possibly through a reheater, not shown) into the rehydrogenation zone 16. Typical operating pressure and temperature for the rehydrogenation zone are, respectively, in the broader range 1050–3100 PSIA and 650°–900° F, and in the preferred range : 1100–2600 PSIA and 700°–800° F.

The products from the rehydrogenation zone 16 are conducted through line 17 into the hydrogen gas withdrawal zone 18 wherein the gasiform products composed essentially of hydrogen are taken off through line 19. The operating pressure in this zone, as well as the operating pressure in the rehydrogenation zone 16 is, in general, maintained higher than in the dissolution-hydrogenation zone 6, for example it is 1250 PSIA in zone 18 versus 1200 PSIA in zone 6, in order to allow the hydrogen rich gas to pass, without recompression, from the zone 18 into the lines 4 and 5 and into the dissolution-hydrogenation zone 6, while the slurry is moving in the direction from the zone 6 to the zone 16. Then the slurryform products left in the zone 18, after the hydrogen rich gas has been withdrawn, are transferred through line 20 into the products separation zone 21 wherein they are separated, for example by filtration, into a heavy-oil slurry or paste and into a liquid oil fraction. The heavy-oil slurry or paste, is sent through line 22 to a further processing (not illustrated in this flow diagram). The liquid oil fraction is passed through line 23 into an oil upgrading and separation zone 24 where the products (obtained in an oil distillation-fractionation operation) comprise the pasting oil recycled through line 3 into the feed preparation zone 2, gaseous hydrocarbons plus impurities taken off through the line 25, bottom heavy residues taken off through line 26, and liquid hydrocarbon product(s) withdrawn through line 27, the three latter streams, conducted by the lines 25, 26, and 27, being removed from the processing system represented by the considered flow diagram.

Optionally, a portion of the slurry is withdrawn from the products separation zone 21 through line 28 and is recycled to the feed preparation zone 2 (to be admixed therein to the mixture of coal and pasting oil), optionally passing through a water washing zone 29 provided with a washing water feed line 30 and a wash-outs removal line 31, then passing through line 32 into an optional acid wash zone 33 provided with a water comprising acid selected from the group comprising hydrochloric acid, sulfuric acid, a carboxylic acid, nitric acid feed line 34 and with an acid wash-outs removal line 35, the slurry passing through line 36 into the optional water washing zone 37 provided with a water wash feed line 38, and with wash-outs removal line 39, the washed slurry passing then, through an optional flash vessel (not shown) for moisture removal under a low pressure, into the line 40 conducting the recycled slurry to the feed preparation zone 2.

As many possible embodiments may be made of the invention without departing from the scope thereof, it is to be understood that all matter herein set forth or shown in the accompanying drawing is to be interpreted as illustrative and not in a limiting sense.

What I claim is:

1. In a process for producing hydrocarbons by hydroliquefaction of coal, comprising passing the coal feed into a coal dissolution-hydrogenation zone wherein subjecting the coal under an operating pressure in the range of 1000 to 3000 PSIA and an operating temperature in the range of 700° to 900° F to reactions with hydrogen for yielding desired hydrocarbons in a mixture of gasiform and slurryform hydrogenated coal products containing asphaltenes, the improvement consisting in admixing to these slurryform products, after the gasiform part of said mixture of products leaving said coal dissolution-hydrogenation zone has been taken-off, an alkali selected from the group consisting of alkali metal hydroxides, alkaline earth metal hydroxides, alkali metal carbonates, ammonium hydroxide, in an amount necessary to break, at least partly, the acid-base type structures of asphaltenes present in said slurryform products, subjecting the latter to react with the admixed said alkali at an operating temperature in the range of 200° F to 900° F and under an operating pressure up to 3000 PSIA, and subjecting the treated slurryform products to reactions with hydrogen in a rehydrogenation zone different from said coal dissolution-hydrogenation zone under an operating pressure and temperature in the range of 1050 PSIA to 3100 PSIA and 650° to 900° F respectively, to yield a mixture of a hydrogen containing rehydrogenation product gas with slurryform rehydrogenation products, and separating the hydrogen containing gas product from said slurryform products of the rehydrogenation.

2. The process of the claim 1, wherein said alkali for breaking the acid-base structures of asphaltenes is in a water diluted form and in this form it is being admixed to said slurryform products.

3. The process of claim 1, comprising admixing, with the said alkali, a carboxylic salt of calcium to said slurryform products.

4. The process of claim 1, wherein said hydrogen with which the coal is subjected to reactions in said dissolution-hydrogenation zone is constituted by the hydrogen contained in said gas product separated from the slurryform products of said rehydrogenation, and directed to said coal dissolution-hydrogenation zone.

5. In a process for producing hydrocarbons by hydroliquefaction of coal, comprising passing hydrogen and coal feed being preheated into a coal dissolution-hydrogenation zone wherein subjecting the coal under an operating pressure in the range of 1000 to 3000 PSIA and an operating temperature in the range of 700° to 900° F to react with hydrogen for yielding desired hydrocarbons in a mixture of gasiform and slurryform hydrogenated coal products containing asphaltenes, the improvement consisting in admixing to these slurryform products, after the gasiform part of said mixture of products leaving said coal dissolution-hydrogenation zone has been taken-off, an alkali selected from the group consisting of alkali metal hydroxides, alkaline earth metal hydroxides, alkali metal carbonates, ammonium hydroxide, in an amount necessary to break, at least partly, the acid-base type structures of asphaltenes present in said slurryform products, subjecting the latter to react with the admixed said alkali at an operating temperature in the range of 200° to 900° F and under an operating pressure up to 3000 PSIA, supplying the treated slurryform products with hydrogen, and subjecting said products to react with the hydrogen in a rehydrogenation zone different from said coal dissolution-hydrogenation zone under an operating pressure and temperature in the range of 1050 PSIA to 3100 PSIA and 650° to 900° F respectively, to yield a mixture of a hydrogen containing rehydrogenation product gas with slurryform rehydrogenation products, and separating the hydrogen containing gas product from said slurryform products of the rehydrogenation.

6. The process of claim 5, wherein said alkali for breaking the acid-base structures of asphaltenes is in a water diluted form, and in this form it is being admixed to said slurryform products.

7. The process of claim 5, comprising admixing, with said alkali, a carboxylic salt of calcium to said slurryform products.

8. The process of claim 5, wherein said hydrogen with which the coal is subjected to react in said dissolution-hydrogenation zone is constituted by the hydrogen contained in said gas product separated from the slurryform products of said rehydrogenation, and directed to said coal feed and into the coal dissolution-hydrogenation zone.

9. The process of claim 5, comprising passing said hydrogen and coal feed being preheated into the coal dissolution-hydrogenation zone through a preheater.

10. The process of claim 1, wherein said alkali for breaking the acid-base structures of asphaltenes comprises sodium hydroxide.

11. The process of claim 1, wherein said alkali for breaking the acid-base structures of asphaltenes comprises ammonium hydroxide.

12. The process of claim 5, wherein said alkali for breaking the acid-base structures of asphaltenes comprises sodium hydroxide.

13. The process of claim 5, wherein said alkali for breaking the acid-base structures of asphaltenes comprises ammonium hydroxide.

* * * * *